US005879749A

United States Patent [19]

Rodrigues et al.

[11] Patent Number: 5,879,749

[45] Date of Patent: Mar. 9, 1999

[54] CROSSLINKABLE FABRIC CARE COMPOSITIONS

[75] Inventors: Klein A. Rodrigues, Signal Mountain; James B. Furr, Hixson, both of Tenn.

[73] Assignee: National Starch and Chemical Investment Holding Corporation, Wilmington, Del.

[21] Appl. No.: 933,623

[22] Filed: Sep. 16, 1997

[51] Int. Cl.[6] ..... D06M 15/623; D06M 10/10; B05D 3/02

[52] U.S. Cl. ..... 427/393.2; 252/8.61; 252/8.62; 252/8.91; 427/393.4

[58] Field of Search ..... 252/8.61, 8.62, 252/8.91; 427/393.2, 393.4

[56] References Cited

U.S. PATENT DOCUMENTS

| | | | |
|---|---|---|---|
| 3,656,885 | 4/1972 | Gagliardi | 252/8.61 |
| 4,436,524 | 3/1984 | Valenti | 252/8.61 |
| 4,443,223 | 4/1984 | Kissling et al. | 252/8.61 |
| 4,624,676 | 11/1986 | White et al. | 252/8.62 |

OTHER PUBLICATIONS

Chemical Abstract No. 67:44755, abstract of an article by Getchell entitled "Recent Developments in Improved Durable Press Cotton", Textilveredlung, 2(6), 373–7, No Month 1967.

Chemical Abstract No. 104:150689, abstract of an article by Frick, Jr. entitled Effects of Crosslink Distribution in Cotton Fibers, Text. Res. J., 56(2), 124–30, No Month 1986.

WPIDS Abstract No. 82–00826E, abstract of Japanese Patent Specification No. 56–155203, Dec. 1981.

*Primary Examiner*—Anthony Green
*Attorney, Agent, or Firm*—John D. Thallemer

[57] ABSTRACT

The present invention relates to fabric treatment compositions that contain an aqueous solution of a poly-functional molecule comprising at least two functional groups selected from the group consisting of carboxyl, anhydride and amine; and a poly(hydroxy) crosslinking agent, and to methods of treating fabric which comprise applying to the fabric an amount of the fabric treatment composition which is effective to impart temporary crease resistance and stain resistance thereto.

7 Claims, No Drawings

CROSSLINKABLE FABRIC CARE COMPOSITIONS

FIELD OF THE INVENTION

The present invention relates to the use of crosslinkable compositions comprising poly-functional polymers and poly (hydroxy) crosslinking agents in the treatment of fabric to impart temporary crease and stain resistance.

BACKGROUND OF THE INVENTION

Starch and starch solutions containing various additives have been used as an ironing aid in home and commercial laundry fabric care applications for over 60 years. While starch has shown to be a good product as an ironing aid for decades, it still has a number of areas where performance could be improved. For instance, there is a tendency for starch to build up on the iron and clothes. Furthermore, starch does not impart long-term wrinkle resistance and the starch solutions may tend to clog up the spray nozzles. Another area for improvement involves starch residue, which sometimes takes the form of flakes on clothing, which may be particularly noticeable on dark fabric. The compositions of the present invention provide such improvements.

SUMMARY OF THE INVENTION

The present invention relates to fabric treatment compositions that comprise an aqueous solution of a combination of a poly-functional molecule comprising at least two functional groups selected from the group consisting of carboxyl, anhydride and amine; and a poly(hydroxy) crosslinking agent. The fabric treatment composition may be applied to clothing and fabric and then pressed, giving the fabric temporary crease resistance, stain resistance and improved anti-redeposition properties in subsequent wash cycles. In addition, there is no build-up of the composition on clothes or irons, and no residual flaking is noted, even on dark fabric. The invention also is directed at methods of treating fabric which comprise applying to the fabric an amount of the fabric treatment composition which is effective to impart temporary crease resistance and stain resistance thereto and pressing the fabric such that the poly(hydroxy) crosslinking agent crosslinks the poly-functional molecule.

DETAILED DESCRIPTION OF THE INVENTION

The fabric treatment compositions according to the present invention comprise a poly-functional molecule (PFM). As used herein, "molecule" includes non-polymeric molecules, low molecular weight polymers or oligomers, for instance having molecular weight of less than about 10,000, and higher molecular weight polymers, for instance having molecular weight of greater than about 10,000 to greater than 1,000,000. The actual molecular weight of the molecule is not a limiting factor with respect to the use of the crosslinking agents of the present invention.

The PFM must contain at least two functional groups selected from the group consisting of carboxyl, anhydride and amine. Exemplary molecules which may be used in the present invention inciude without limitation citric acid, 1,2,4-benzene tricarboxylic acid, 1,2,4,5-benzene tetracarboxylic acid, 1,2,3,4-butane tetracarboxylic acid, poly (acrylic acid), carboxylic-acid-functionalized polyesters, carboxylic-acid-functionalized polyurethanes, polyethylenimine, poly(vinyl amine-covinyl alcohol), poly (vinyl amines) and polymers prepared from monomers such as ethylene (E), vinyl acetate (VA), (meth)acrylic acid (M)AA, the $C_1$–$C_8$ alkyl esters of (meth)acrylic acid, maleic anhydride (MAnh), maleic acid, itaconic acid (IA), crotonic acid (CA), β-carboxy ethyl acrylate (BCEA), butadiene and styrene (STY). (Meth)acrylic is used herein to denote both acrylic and methacrylic acids and esters thereof. Exemplary copolymers include ethylene/vinyl acetate/acrylic acid copolymers, vinyl acetate/acrylic acid copolymers, acrylic acid/maleic anhydride copolymers, vinyl acetate/acrylic acid/maleic anhydride copolymers, ethylene/acrylic acid copolymers, ethylene/methacrylic acid copolymers, ethylene/vinyl acetate/acrylic acid/maleic anhydride copolymers, vinyl acetate/maleic anhydride copolymers, ethylene/vinyl acetate/maleic anhydride copolymers, methyl methacrylate/butyl acrylate/acrylic acid copolymers, methyl methacrylate/ethyl acrylate/acrylic acid copolymers, methyl methacrylate/butyl acrylate/itaconic acid copolymers, butyl acrylate/acrylic acid copolymers, butyl acrylate/BCEA copolymers, ethyl acrylate/acrylic acid copolymers, 2-ethylhexyl acrylate/acrylic acid copolymers, methyl methacrylate/ethyl (meth)acrylate/itaconic acid copolymers, styrene/(meth)acrylic acid copolymers, styrene/maleic anhydride copolymers, styrene/(meth)acrylic acid/maleic anhydride copolymers, styrene/itaconic acid copolymers and styrene/butadiene copolymers. Additionally, polymers comprising anhydride groups may be generated in situ during preparation of poly(acrylic acid). These examples are not limiting and the (hydroxyalkyl)urea crosslinking agents according to the present invention may be used to crosslink virtually any molecule which comprises at least two functional groups selected from the group consisting of carboxyl, amine and anhydride. The (hydroxyalkyl)urea crosslinking agent is very versatile and may be used easily to crosslink aqueous solution polymers, organic solution polymers, polymer melts, emulsion polymers, aqueous and non-aqueous dispersions of polymers, and powders.

The fabric treatment compositions of the present invention also comprise poly(hydroxy) crosslinking agents, i.e., polyols, that contain at least two hydroxyl groups. Examples of polyols include ethylene glycol, glycerol, pentaerythritol, sorbitol, sucrose, starch and starch derivatives, diethanolamine, triethanolamine, β-hydroxyalkyl amides such as bis-[N,N-di(β-hydroxyethyl)]-adipamide, polyvinyl alcohol and urea derivatives.

The most preferred poly(hydroxy) crosslinking agents of the present invention are derived from urea, comprise only a single urea group, at least two hydroxyl groups, at least two carbon atoms disposed between the urea group and each of the hydroxyl groups, and may include compounds represented by Structure (1). The two carbons disposed between the hydroxyl and urea groups may be in linear, branched or substituted configuration. These urea derivatives may be dimethylol dihydroxy ethyl urea (DMDHEU), glycolated and methylated DMDHEU, and hydroxyalkyl ureas such as N,N-bis(2-hydroxyethyl)urea. The hydroxyalkyl ureas (HAU) such as N,N-bis(2-hydroxyethyl)urea are most preferred.

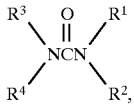

(I)

where $R^1$ is $$\begin{array}{c} R^5 \\ | \\ C-R^7, \\ | \\ R^6 \end{array}$$

$R^2$ is H or $R^5$, $R^3$ is H or $R^5$, and $R^4$ is H, $R^1$, or $R^5$, where $R^5$ is $$\text{H, } CH_2OH, \overset{R^8\ R^9}{\overset{|\ \ |}{CHCHOH}}, \overset{R^8\ R^9\ R^{10}}{\overset{|\ \ |\ \ |}{CHCHCHOH}} \text{ or } C_1\text{–}C_4\text{alkyl,}$$

$R^6$ is $$\text{H, } CH_2OH, \overset{R^8\ R^9}{\overset{|\ \ |}{CHCHOH}}, \overset{R^8\ R^9\ R^{10}}{\overset{|\ \ |\ \ |}{CHCHCHOH}} \text{ or } C_1\text{–}C_4\text{alkyl,}$$

and $R^7$ is $$\text{H, } CH_2OH, \overset{R^8\ R^9}{\overset{|\ \ |}{CHCHOH}}, \overset{R^8\ R^9\ R^{10}}{\overset{|\ \ |\ \ |}{CHCHCHOH}} \text{ or } C_1\text{–}C_4\text{alkyl,}$$

where $R^8$ is H, methyl or ethyl, $R^9$ is H, methyl or ethyl, and $R^{10}$ is H, methyl or ethyl.

Exemplary HAU crosslinkers include, without limitation, N,N-bis(2-hydroxyethyl)urea, tetrakis(2-hydroxyethyl)urea, tris(2-hydroxyethyl)urea, N,N'-bis(2-hydroxyethyl)urea, N,N'-bis(3-hydroxypropyl)urea, N,N'-bis(4-hydroxybutyl) urea and 2-urea-2-ethyl-1,3-propanediol. The terms "crosslinking agent" and "crosslinker" are used interchangeably herein.

The garments, clothing and fabric to which the invention is applied are finished goods, that is garments and clothing which already have been manufactured or fabric which has been manufactured and sold for the manufacture of clothes and the like. The invention does not apply to textiles that are in the finishing process or processes for making textiles or fabric. Treatment of the fabric with compositions of the present invention result in the fabric exhibiting good hand (feel). In addition, clothes that have been treated with this composition and pressed tend to retain their crease longer than those treated with conventional fabric treatment compositions. This crease resistance is temporary since the film dissolves in the washing machine. Treatment of the fabric with compositions of the present invention also result in the fabric exhibiting improved stain resistance over conventional fabric treatment compositions. For example, stains applied to fabric treated with the compositions of the present invention tend to be immobilized; that is, there is no noticeable migration of the stain throughout the fabric, when compared to stains applied to fabric treated with conventional compositions. In addition, stains that have been applied to the fabric are removed easily by conventional washing when compared to stains applied to fabric treated with conventional fabric treatment compositions. Furthermore, the polymer also acts as an anti-redeposition agent in subsequent washes. This system therefore could be used by laundromats and companies that launder linens for caterers and eating establishments. It was surprising and unexpected that the water treatment composition of the present invention would provide fabric treated therewith with the combined properties of temporary crease and stain resistance and anti-redeposition in wash.

The fabric treatment compositions of the present invention comprise an aqueous solution of a combination of the PFM and the poly(hydroxy) crosslinking agent in relative amounts such that the ratio of the sum total number of equivalents of the functional groups contained in the PFM to the number of equivalents of the hydroxyl groups contained in the poly(hydroxy) crosslinker ranges from about 1:1 to about 100:1. Preferably, the ratio of the sum total number of equivalents of the functional groups contained in the PFM to the number of equivalents of the hydroxyl groups contained in the poly(hydroxy) crosslinker ranges from about 5:4 to about 10:1.

In one embodiment of the invention, the fabric treatment compositions may be applied to the fabric in the form a fine mist as an ironing or pressing aid, for instance by pump or aerosol spray, and the fabric then pressed with the application of heat and pressure, optionally with steam. Fabric is used herein to include garments, clothing and other finished goods as described herein. The application and pressing may be performed in commercial laundry operations or may performed in household applications, such as by an iron, with or without steam. The heat from the iron causes the crosslinking of the PFM by the poly(hydroxy) crosslinking agent to occur on the surface of the fabric. A thin invisible film is left behind which provides the fabric with temporary crease and stain resistance. While not intending to be bound by the following, it is believed that the crosslinking agent also may tend to crosslink bonds within the cellulosic fibers themselves.

In applications such as those described above, it is essential that the fabric treatment compositions do not contain high levels of a combination of PFM and crosslinking agent. High levels are considered to be on the order of 20 weight percent and higher of a combination of the PFM and crosslinking agent. The viscosity of the ironing aid must be sufficiently low in order for the ironing aid to be applied via pump or aerosol sprays. Should the solids content become too high, the viscosity may be too high and spray application problems may be encountered. Accordingly, the ironing aid comprises a total of from about 0.1 to about 10 weight percent of a combination of the PFM and poly(hydroxy) crosslinking agent, in the above-noted relative proportions, based on total weight of the ironing aid composition.

An alternate method of applying the fabric treatment composition to fabric would be to introduce the composition into the rinse cycle of a washing machine. While in spray applications described above it is essential to use relatively low levels of the fabric treatment composition, viscosity and spray are not issues in rinse cycle applications. Accordingly, the fabric treatment composition may be used at higher concentrations in the rinse cycles if desired, although it should not be necessary to apply the composition at concentrations greater than about ten weight percent in order to achieve the benefits of the present invention. Residual amounts of the fabric treatment composition then are deposited on the laundered garments in amounts effective to provide the garments with temporary crease resistance and stain resistance upon pressing. The treated garments then may be ironed directly or may be dried prior to pressing. Drying removes the excess water from the garments, leaving behind the PFM and the crosslinker, which then may be pressed, producing the desirable properties described before.

It is known that water soluble starches are used in commercial laundromats. The starches are introduced into a bath or a vat at the end of the cleaning operation. The excess water then is drained and the residual starch deposited on the fabric gives the garments the desired stiffness upon pressing. The water soluble starch in this application may be replaced by the fabric treating compositions of the present invention. Once again, residual amounts of the PFM and crosslinker are deposited on the fabric after the water is rinsed off. If desired, additional fabric treatment composition may be applied in the form of the spray ironing aid after washing and then pressed.

A preferred fabric treatment composition comprises an aqueous solution of a mixture of poly(acrylic acid) and dihydroxyethyl urea. The fabric treatment composition is applied to the fabric by spraying a 4 weight percent solution of this mixture, based on total weight of the solution, onto the fabric and then ironing the fabric. The heat of the iron causes the polymer to crosslink into a thin nearly invisible film even on black fabric.

EXAMPLES

Example 1.

Subjective Crease Resistance

An ironing aid composition comprising 182 grams of water, 16.7 grams of Alcosperse® 602N poly(acrylic acid) (available from Alco Chemical Company, Chattanooga, Tenn.) (45% active) and 1.0 gram of dihydroxyethyl urea (85% active) was stirred together for 30 minutes until a solution was formed. This is a 4 percent solution of the fabric treatment composition.

The formulation of Example 1 was tested by a panel of users in actual everyday conditions. The solution was sprayed onto fabric and the clothes were then worn for an entire day. The observations of the panel as to the crease resistance of the test composition are listed in Table 1.

TABLE 1

| Test Person No. | Garment ironed | Crease resistance |
|---|---|---|
| 1 | white dress shirt | Yes |
| 2 | Linen suit | Yes |
| 3 | Cotton and Rayon pants | Yes |
| 4 | Dark, Cotton pants | Yes |

As the data indicates, the fabric treatment composition of Example 1 provides excellent crease resistance to fabric treated therewith.

Example 2.

Test for Measuring Stiffness

Federal Test Method Std. No. 191A was conducted to measure stiffness of swatches treated with the fabric treatment compositions. The stiffness of the swatches is in direct proportion to the effectiveness of the crosslinker. The test consists of treating a rectangular piece of cotton swatch that is 10"×1" with the fabric treating composition. The swatch is then attached to a horizontal bar using two pieces of scotch tape, such that the swatch hangs down in the form of a loop. The distance from the top of the bar to the bottom of the looped swatch is then measured after 1 minute. This distance is inversely proportional to the stiffness of the swatch.

The stiffness of a series of swatches treated with Alcosperse® 602A poly(acrylic acid) (from Alco Chemical Company in Chattanooga, Tenn.) and a number of crosslinkers was measured and reported in Table 2.

TABLE 2

| Crosslinker | Distance from bar measured after 1 minute (mm) | Comments on the ease of ironing |
|---|---|---|
| No polymer or crosslinker | 11.3 | |
| Polymer by itself | 10.0 | Easy smooth |
| hydroxy ethyl urea | 9.0 | Easy |
| DMDHEU | 9.0 | Difficult |
| Glycolated DMDHEU | 9.65 | Easy |
| Filmkote 54 | 9.7 | Very difficult |
| Mono hydroxy ethyl urea | 10.0 | Easy |
| triethanol amine | 9.7 | Easy |

All of the fabric treatment compositions were applied as 4 weight percent aqueous solutions of the Alcosperse® 602A poly(acrylic acid), with the crosslinker being utilized at a level of 12 weight percent, based on weight of the poly(acrylic acid). Filmkote® 54 is a water soluble starch available from National Starch and Chemical Company, Bridgewater N.J., that may be used as a crosslinker. Monohydroxy ethyl urea is not an effective crosslinker in the present invention. Surprisingly, the triethanol amine salt of poly(acrylic acid) is a good crosslinker. These systems may be catalysed by an acid such as urea sulfate.

Example 3.

Stain Resistance

A number of commercial fabric treatment compositions were evaluated for stain resistance along with the fabric treatment composition of Example 1. The spangler sebum stain was applied to a 2 inch diameter circle on the swatch and the swatch then was baked in an oven at 70° C. for 5 days. Upon removal from the oven, the swatches were observed visually to note any migration of the stain across the swatch. The swatches then were washed in a terg-o-tometer using 0.9 grams/liter of commercial Purex® powdered detergent and the swatches again observed for staining.

TABLE 3

| Ironing aid | Visual description of stain after baking and before washing | Visual Rating of stain after wash (1 = best) | Visual description of stain after wash |
|---|---|---|---|
| Fabric treatment composition of Example 1 | stain did not spread over the entire wash | 1 | Clean white appearance |
| Niagara ® spray starch | stain spread over entire swatch | 2 | Yellow sebum stain |
| Faultless starch | stain spread over entire swatch | 4 | Yellow sebum stain |
| Fabric Finish | stain spread over entire swatch | 3 | Yellow sebum stain |

The data in Table 3 indicates that the fabric treatment composition of Example 1 is superior to conventional fabric treatment compositions in that it not only prevents the spreading of the stain over the entire swatch, but is also renders the stain removable upon conventional washing; hence, it tends to resist stains. The white swatch treated with the composition of Example 1 was completely clean and white after washing in the terg-o-tometer. In contrast, the stain spread all over the comparative swatches treated with the commercial materials and all of the comparative swatches exhibited the characteristic yellow stain, even after the washing.

Example 4

These test of Example 3 was repeated using a 2:1 ratio of Olive Oil to Bandy Black Clay.

TABLE 4

| Ironing aid | Visual rating (1 being the best) | Ave $\Delta L^{(1)}$ of preironed swatches | Visible deposits on dark fabric | Redeposition |
|---|---|---|---|---|
| Fabric treatment composition of Example 1 | 1 | 20.5 | None | None |
| Fabric Finish | 2 | 13.1 | Yes | Substantial |
| Niagara Starch | 3 | 0.7 | Yes | Substantial |

(1)ΔL = difference in reflectance of stained swatches before wash and after wash, as measured by Minolta CM 525 Colorimeter.

The fabric treatment composition of Example 1 provided excellent stain resistance and did not exhbit any redeposition problems. Furthermore it did not show any visuial deposits, even on dark fabric. The Niagara starch and the Fabric Finish performed poorly compared to the composition of the present invention and exhibited substantial redeposition. Furthermore, the Fabric Finish solution is hard to spray at the higher concentrations and tended to form a sticky residue on the fabric.

We claim:

1. A fabric treatment composition which imparts crease and stain resistance to fabrics treated therewith, said fabric treatment composition comprising:

(a) 0.1 to about 10 weight percent, based on the total weight of the fabric treatment composition, of a polymer having at least two carboxyl groups;

(b) a poly(hydroxy) crosslinking agent; and (c) water, wherein the ratio of the sum total number of equivalents of functional groups in the polymer having at least two carboxyl groups to the number of equivalents of hydroxyl groups in the poly(hydroxy) crosslinking agent is from about 1:1 to about 100:1.

2. The fabric treatment composition according to claim 1 wherein the ratio of the sum total number of equivalents of functional groups in the polymer having at least two carboxyl groups to the number of equivalents of hydroxyl groups in the poly(hydroxy) crosslinking agent is from about 5:4 to about 10:1.

3. The fabric treatment composition according to claim 1 wherein said crosslinking agent is selected from the group consisting of N,N-bis(2-hydroxyethyl)urea, tetrakis(2-hydroxyethyl)urea, tris(2-hydroxyethyl)urea, N,N'-bis(2-hydroxyethyl)urea, N,N'-bis(3-hydroxypropyl)urea, N,N'-bis(4-hydroxybutyl)urea and 2-urea-2-ethyl-1,3-propanediol.

4. The fabric treatment composition according to claim 1 wherein the polymer having at least two carboxyl groups is polyacrylic acid.

5. A method of treating fabric to impart temporary crease and soil resistance thereto, the method comprising:

(i) applying to the fabric an amount of a fabric treatment composition effective to impart temporary crease and stain resistance thereto, said fabric treatment composition comprising (a) 0.1 to about 10 weight percent, based on the total weight of the fabric treatment composition, of a polymer having at least two carboxyl groups;

(b) a poly(hydroxy) crosslinking agent; and (c) water, wherein the ratio of the sum total number of equivalents of functional groups in the polymer having at least two carboxyl groups to the number of equivalents of hydroxyl groups in the poly(hydroxy) crosslinking agent is from about 1:1 to about 100:1; and (ii) heating the fabric treatment composition to form a crosslinked film on the fabric.

6. The method according to claim 5 wherein said crosslinking agent is selected from the group consisting of N,N-bis(2-hydroxyethyl)urea, tetrakis(2-hydroxyethyl)urea, tris(2-hydroxyethyl)urea, N,N'-bis(2-hydroxyethyl)urea, N,N'-bis(3-hydroxypropyl)urea, N,N'-bis(4-hydroxybutyl)urea and 2-urea-2-ethyl-1,3-propanediol.

7. The method according to claim 5 wherein the polymer having at least two carboxyl groups is polyacrylic acid.

* * * * *